US009622311B1

(12) United States Patent
Fries et al.

(10) Patent No.: US 9,622,311 B1
(45) Date of Patent: Apr. 11, 2017

(54) SUB-ASSEMBLY FOR SEARCHLIGHT SIGNAL, AND ASSOCIATED ASSEMBLY

(71) Applicant: ALSTOM TRANSPORT TECHNOLOGIES, Saint-Ouen (FR)

(72) Inventors: Jeffrey Fries, Lee's Summit, MO (US); Brian Tiemann, Buckner, MO (US); Charles Crawford, Blue Springs, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 0 days.

(21) Appl. No.: 15/093,601

(22) Filed: Apr. 7, 2016

(51) Int. Cl.

| | |
|---|---|
| ***H05B 33/08*** | (2006.01) |
| ***F21V 23/00*** | (2015.01) |
| ***F21V 14/08*** | (2006.01) |
| ***F21S 8/00*** | (2006.01) |
| ***B61L 9/04*** | (2006.01) |
| *F21Y 113/13* | (2016.01) |
| *F21Y 115/10* | (2016.01) |
| *F21W 131/10* | (2006.01) |

(52) U.S. Cl.
CPC ..... *H05B 33/0842* (2013.01); *B61L 9/04* (2013.01); *F21S 8/003* (2013.01); *F21V 14/08* (2013.01); *F21V 23/005* (2013.01); *H05B 33/0815* (2013.01); *F21W 2131/10* (2013.01); *F21Y 2113/13* (2016.08); *F21Y 2115/10* (2016.08)

(58) Field of Classification Search
CPC ..... H05B 37/0272; H05B 33/0845; H05B 33/0854; H05B 37/0227; H05B 37/0281; H05B 33/0803; H05B 33/089; H05B 33/0809; H05B 33/0842; H05B 33/0815; H05B 33/0818; H05B 33/0872; H05B 37/0218
See application file for complete search history.

(56) References Cited

U.S. PATENT DOCUMENTS

| | | | | |
|---|---|---|---|---|
| 6,642,666 | B1 | 11/2003 | St-Germain | |
| 2004/0105264 | A1* | 6/2004 | Spero | B60Q 1/04 362/276 |
| 2008/0297065 | A1* | 12/2008 | Mubaslat | B64D 27/04 315/291 |
| 2012/0206050 | A1* | 8/2012 | Spero | B60Q 1/04 315/152 |

OTHER PUBLICATIONS

LED Retro-fit Kits for Searchlight Signals, Invensys Westinghouse Australia, Datasheet 1A-13 version 7.0.
Sigmaguard Style LS Searchlight Replacement Signal, Siemens Rail Automation Pty Ltd, Datasheet 1A-16 issue 8.0.

* cited by examiner

*Primary Examiner* — Monica C King
(74) *Attorney, Agent, or Firm* — Knobbe Martens Olson & Bear LLP

(57) ABSTRACT

The invention relates to a sub-assembly for a searchlight signal comprising three distinct light emitting diodes and an interface module for connecting the three diodes to a controller.
The interface module comprises:
a light input adapted to receive a signal for feeding a light emitting diode,
a first relay having an active position and an inactive position, and
a second relay having an active position and an inactive position,
such that:
when the second relay and the first relay are in the inactive position, the light input is fed to a first LED,
when the first relay is in the active position, the light input is fed to a second LED, and
when the second relay is in the active position, the light input is fed to a third LED.

13 Claims, 1 Drawing Sheet

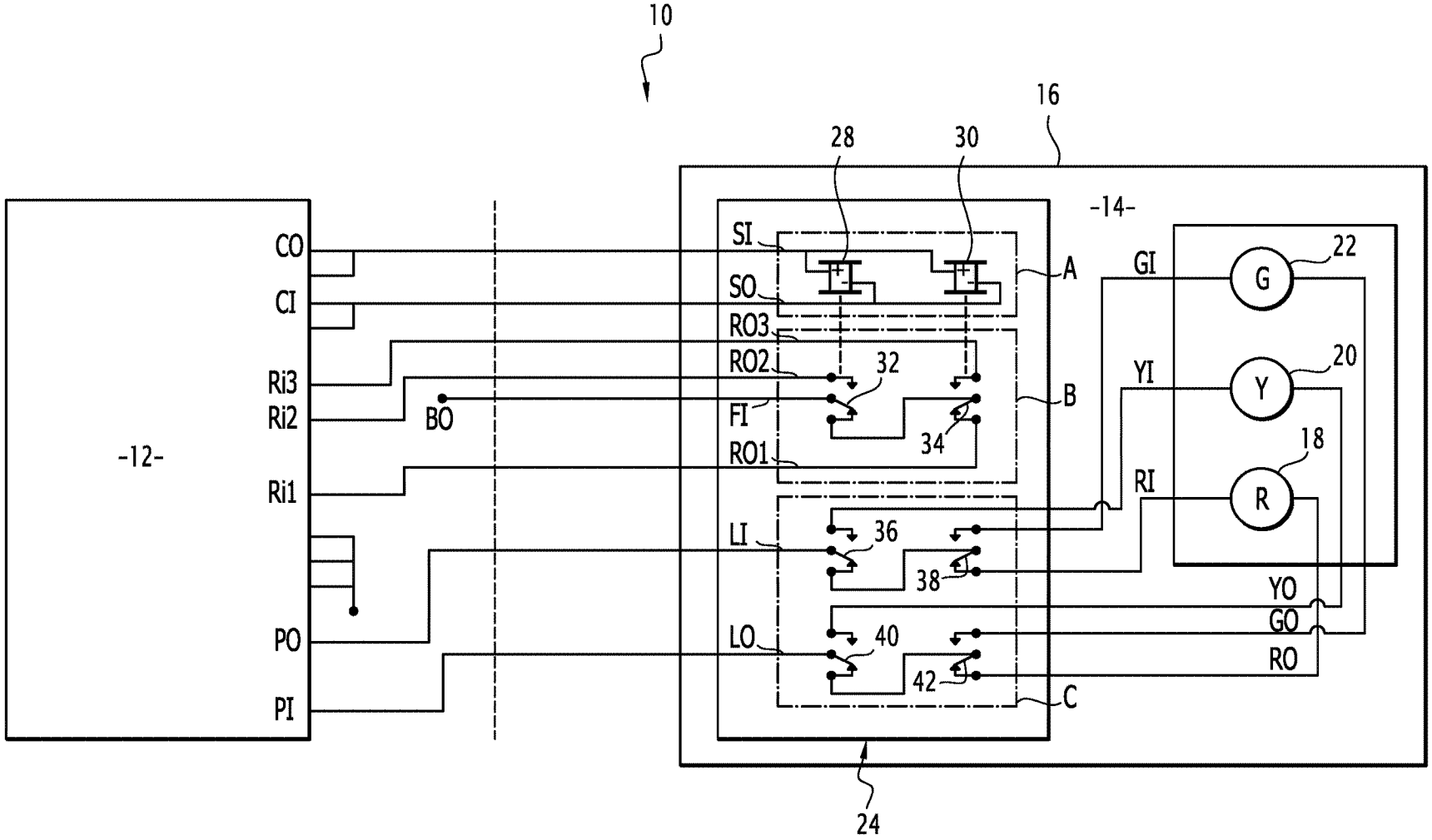
10
16
-14-
22
20
18
G
Y
R
GI
YI
RI
YO
GO
RO
A
B
C
30
28
34
32
38
36
42
40
24
SI
SO
RO3
RO2
FI
RO1
LI
LO
BO
CO
CI
Ri3
Ri2
Ri1
PO
PI
-12-

SUB-ASSEMBLY FOR SEARCHLIGHT SIGNAL, AND ASSOCIATED ASSEMBLY

FIELD OF THE INVENTION

The present invention concerns a sub-assembly for searchlight signal, and associated assembly.

BACKGROUND OF THE INVENTION

Searchlight signals are used along railway tracks to convey information to the train driver, they can display three colours, usually red, yellow or green.

They are traditionally composed of a single incandescent lamp bulb and three coloured filters to be placed selectively in front of the bulb. A mechanism selects the proper filter to be used. This system is controlled by an external control voltage fed by a controller. In the absence of any control voltage, the red filter remains in front of the bulb, displaying a red aspect. If the control voltage is positive (12V), the yellow filter is moved in front of the bulb and a yellow aspect is displayed. If the control voltage is negative (−12V), the green lens is placed in front of the bulb, displaying a green aspect. Terminals are also providing feedback information to the controller regarding which colour is currently displayed or not displayed.

The maintenance costs of such a searchlight signal are high due to the relatively short life of the incandescent lamps and the required periodic maintenance and calibration of the mechanism.

Railroads are moving towards replacing incandescent bulbs with Light-Emitting Diodes (LEDs) as signals, resulting in increased visibility and longer life.

However there are two major issues with replacing incandescent bulbs with LEDs in searchlight signals. First, the existing cables buried in the ground between the controller and the searchlight signal may not support the wire gauge necessary to interface to the LED signal since the searchlight control and feedback interfaces are low current interfaces. Second, the logic in the controller must be changed to properly interface to the LED signal since the LED signal does not have the same electrical interface to the controller as the searchlight mechanism and incandescent bulb. Both of these modifications are extremely costly.

The document U.S. Pat. No. 6,642,666 B1 describes a searchlight signal comprising a colour selection interface to select the display aspect, a plurality of LEDs and a switching power supply.

However, it requires many components (diodes, resistors, relays, etc.) to electrically steer the current to the appropriate LED. This interface is costly and difficult to design to ensure safe design principles: by default, in case of problem, the signal must be red or not lit.

SUMMARY OF THE INVENTION

One of the aims of the invention is therefore to propose a simple sub-assembly for a LED searchlight signal that can be easily fitted into existing signal systems.

According to the invention, this object is achieved by a sub-assembly as described, wherein the interface module comprises

- a light input adapted to receive a signal for feeding a light emitting diode,
- a selecting circuitry interposed between the light input and the light emitting diodes, the selecting circuitry being adapted to select one light emitting diodes to be fed by the signal received by the light input,
- a first relay having an active position and an inactive position, and
- a second relay having an active position and an inactive position,
- the first relay and the second relay controlling the selecting circuitry, such that:
  - when the second relay and the first relay are in the inactive position, the light input is fed to a first LED,
  - when the first relay is in the active position, the light input is fed to a second LED, and
  - when the second relay is in the active position, the light input is fed to a third LED.

The sub-assembly of the invention allows to easily upgrade to LED-technology without requiring modifications to the existing logic of the controller, while reusing the existing cables buried in the ground.

According to particular embodiments, the sub-assembly includes one, several or all of the following features, in all technically possible combinations:

- the selecting circuitry comprises conducting lines with two-position switches,
- each two-position switch is commanded by the relays,
- the selecting circuitry consists of conducting lines with two two-position switches,
- each two-position switch is commanded by a respective relay,
- the first LED is a red LED,
- the interface module comprises a switching input and a switching output adapted to receive a voltage signal, the first relay and the second relay being connected between the position when a signal having a first voltage is received, the second relay being in the active position when a signal having a second voltage is received.
- the first relay and the second relay are combined into a single relay, the inactive position of the first relay and the inactive position of the second relay being an inactive position of the single relay, the active position of the first relay being a first active position of the single relay, the active position of the second being a second active position of the single relay,
- the interface module comprises:
  - a first reference output,
  - a second reference output,
  - a third reference output and
  - a feedback input,
- the first relay and the second relay being further adapted such that:
  - when the second relay and the first relay are in the inactive position, the first reference output and the feedback input are connected,
  - when the first relay is in the active position, the second reference output and the feedback input are connected, and
  - when the second relay is in the active position, the third reference output and the feedback input are connected.

The invention also relates to an assembly comprising:

- a sub-assembly as previously described,
- a searchlight signal housing, the sub-assembly being fitted inside the housing, and
- a controller adapted to control one bulb and three filters and having a power output adapted to feed a signal to the light input, the power output of the controller being connected to the light input of the interface module.

According to particular embodiments, the assembly includes one, several or all of the following features, in all technically possible combinations:

the interface module comprises a switching input and a switching output adapted to receive a voltage signal, the first relay and the second relay being connected to the switching input and output in parallel, the first relay being in the active position when a signal having a first voltage is received, the second relay being in the active position when a signal having a second voltage is received, terminals of the controller being connected to the switching input and output of the interface module, the controller being adapted to feed a voltage signal to the switching input and output.

the controller comprises:

a first reference input, a second reference input and a third reference input and the interface module comprises:

a feedback input, the first relay and the second relay being further adapted such that:

when the second relay and the first relay are in the inactive position, the first reference input and the feedback input are connected, when the first relay is in the active position, the second reference input and the feedback input are connected, and when the second relay is in the active position, the third reference input and the feedback input are connected, a signal being fed by the controller to the light input when the reference input coupled to the feedback input is coherent with the voltage signal fed to the switching input.

The invention also relates to a train infrastructure comprising an assembly as described previously.

BRIEF DESCRIPTION OF THE DRAWINGS

Other aspects and advantages of the invention will appear upon reading the following description, given by way of example and made in reference to the appended drawing representing a block diagram of an assembly comprising a sub-assembly according to an embodiment of the invention.

DESCRIPTION OF PREFERRED EMBODIMENTS

In the remainder of the description, an input or an output is to be understood as an electrical terminal. The expressions "input terminal" or "output terminal" are not used in the following by commodity.

An assembly 10 to be used as a searchlight signal is shown in FIG. 1.

The assembly 10 comprises a controller 12, a sub-assembly 14 and a searchlight signal housing 16, the sub-assembly 14 being fitted inside the housing 16.

The controller 12 is adapted to control one incandescent bulb and three filters.

The controller 12 is, for example, located in a bungalow, eventually with other equipment.

The controller 12 comprises the following terminals:

a power output PO, a power input PI, a first reference input RI1, a second reference input RI2, a third reference input RI3, a control output CO, and a control input CI.

The controller 12 is adapted to generate a signal, such as an output voltage, between the power input PI and the power output PO.

The output voltage is, for example, used to energize the searchlight incandescent bulb.

The controller 12 is adapted to detect whether a feedback voltage signal is measured at any of the reference input.

The voltage between electrical ground and each of the first reference input RI1, the second reference input RI2 and the third reference input RI3 is, for example, measured continuously or at a regular pace. As an example, voltage present on the input RI1 may indicate that a first filter is placed in front of the searchlight bulb, voltage present on the input RI2 may indicate that a second filter is placed in front of the searchlight bulb, and voltage present on the input RI3 may indicate that the third filter is placed in front of the searchlight bulb.

The controller 12 is adapted to generate a voltage signal between the control output CO and the control input CI.

The control output CO and the control input CI provide a bipolar DC drive.

The voltage signal from the control input CI to the control output CO has, for example, either a first voltage or a second voltage, both voltages being different from 0V. The first voltage is, for example, +12V (volts) and the second voltage is −12V.

The sub-assembly 14 comprises three distinct Light-Emitting Diodes (LEDs) 18, 20, 22 and an interface module 24.

The three LEDs are located outside the bungalow.

The three LEDs are mounted in parallel in a respective loop having two free ends.

Each LED is, for example, a single LED or a LED array.

LEDs of the same array are distributed on a printed circuit board. The LED arrays are spread substantially evenly in a window, such that when a LED array is lit, the window is entirely lit by the LED array. The printed circuit boards are located one behind the other in the window.

Each array is arranged so that all LEDs of an array are in series and parallel, such that the break of one LED of the array does not result in the loss of the whole array.

Each LED has a particular colour according to the different colours to be displayed by the searchlight signal.

In many rail regulations, the standard colours are red, yellow and red. Therefore, a first LED 18 is red, a second LED 20 is yellow and the third LED 22 is green.

Each LED has an input GI, YI, RI and an output GO, YO, RO.

The interface module 24 comprises the following terminals coupled to the controller 12:

a light input LI coupled to the power output PO, a light output LO coupled to the power input PI, a first reference output RO1 coupled to the first reference input RI1, a second reference output RO2 coupled to the second reference input RI2, a third reference output RO3 coupled to the third reference input RI3, a switching input SI coupled to the control output CO, and a switching output SO coupled to the control input CI.

The interface module 24 further comprises a feedback input FI connected to a battery output BO. The battery output BO is adapted to feed a voltage signal to the feedback input FI.

The interface module 24 comprises three circuitries: a controlling circuitry A, a feedback circuitry B and a selecting circuitry C.

The controlling circuitry A will now be described.

The switching input SI and the switching output SO are adapted to receive a voltage signal.

The switching input SI and the switching output SO are coupled through a first relay 28 and a second relay 30.

The first relay 28 and the second relay 30 are connected between the switching input SI and the switching output SO in parallel.

The first relay 28 has an active position and an inactive position.

The first relay 28 is in the active position when a signal having the first voltage is received between the switching input SI and the switching output SO. The first relay 28 is a biased neutral relay.

The second relay 30 has an active position and an inactive position.

The second relay 30 is in the active position when a signal having the second voltage is received between the switching input SI and the switching output SO. The second relay 30 is a biased neutral relay.

The first voltage and the second voltage are different, such that the first relay 28 and the second relay 20 are not in the active position at the same time.

When the voltage is different from the first voltage and the second voltage, neither the first relay 28 nor the second relay 30 is in the active position.

In one embodiment, the first relay and the second relay are combined into a single relay with specific operation based on bipolar voltage across a single coil.

The inactive position of the first relay and the inactive position of the second relay correspond to an inactive position of the single relay. The active position of the first relay corresponds to a first active position of the single relay. The active position of the second relay corresponds to a second active position of the single relay.

The feedback circuitry B will now be described.

The feedback circuitry B comprises a first two-position switch 32 and a second two-position switch 34.

Each feedback switch 32, 34 has a single input and two outputs. Each feedback switch 32, 34 is adapted to couple its input to one of its outputs. Each feedback switch 32, 34 is, for example, a Form C relay contact.

The input of the first feedback switch 32 is coupled to the feedback input FI. A first of the outputs of the first feedback switch 32 is coupled to the second reference output RO2. The second output of the first feedback switch 32 is coupled to the input of the second feedback switch 34. The outputs of the second feedback switch 34 are coupled respectively to the first reference output RO1 and the third reference output RO3.

The controlling circuitry A and the feedback circuitry B are interconnected such that the first relay 28 and the second relay 30 are adapted to control the feedback switches 32, 34.

When both the first relay 28 and the second relay 30 are in the inactive position (as depicted on the FIGURE), the first feedback switch 32 couples the feedback input FI and the input of the second feedback switch 34 which is coupled to the first reference output RO1 though the second feedback switch 34.

When both the first relay 28 and the second relay 30 are in the inactive position, the feedback input FI is coupled to the first reference output RO1 through the feedback switches. The second and third reference outputs RO2, RO3 are not connected to a non-zero voltage.

When the first relay 28 is in the active position, the first feedback switch 32 couples the feedback input FI with the second reference output RO2. The first and third reference outputs RO1, RO3 are not connected to a non-zero voltage.

When the second relay 30 is in the active position, the first feedback switch 32 couples the feedback input FI and the input of the second feedback switch 34 which is coupled to the third reference output RO3 through the second feedback switch.

When the second relay 30 is in the active position, the feedback input FI is coupled to the third reference output RO3 through the feedback switches. The first and second reference outputs RO1, RO2 are not connected to a non-zero voltage.

The selecting circuitry C will now be described.

The selecting circuitry is interposed between the light input and the light emitting diodes. The selecting circuitry is adapted to select one light emitting diodes to be fed by the signal received by the light input.

The selecting circuitry C comprises conducting lines with two-position switches 36, 38, 40, 42.

The selecting circuitry C consists of conducting lines with two-position switches 36, 38, 40, 42.

Each two-position switch is commanded by the relays.

Each two-position switch is commanded by a respective relay.

The selecting circuitry C comprises a first two-position switch 36, a second two-position switch 38, a third two-position switch 40 and a fourth two-position switch 42.

The switches are adapted to connect one of the two free ends of one loop comprising a LED to the light input.

The first and the second switches 36, 38 are adapted to control which input of the LEDs is coupled to the light input.

The third and the fourth switches 40, 42 are adapted to control which output of the LEDs is coupled to the light output.

The first and the second switches 36, 38 and the third and the fourth switches 40, 42 are organised similarly regarding the input of the LEDs and the light input, respectively the output of the LEDs and the light output.

Each switch has a single input and two outputs. Each switch is adapted to couple its input to either of its outputs. Each switch is, for example, a Form C relay contact.

The input of the first switch 36 is coupled to the light input LI. A first of the outputs of the first switch 36 is coupled to the yellow input YI. The second output of the first switch 36 is coupled to the input of the second switch 38. The outputs of the second switch 38 are coupled respectively to the green input GI and the red input RI.

The input of the third switch 40 is coupled to the light output LO. A first of the outputs of the third switch 40 is coupled to the yellow output YO. The second output of the third switch 40 is coupled to the input of the fourth switch 42. The outputs of the fourth switch 42 are coupled respectively to the green output GO and the red output RO.

The controlling circuitry A and the selecting circuitry C are interconnected such that the first relay 28 and the second relay 30 are adapted to control the selecting circuitry C.

When both the first relay 28 and the second relay 30 are in the inactive position (as depicted on the FIGURE), the first switch 36 couples the light input LI and the input of the second switch 38 which is coupled to the red input RI though the second switch 38.

When both the first relay 28 and the second relay 30 are in the inactive position, the light input LI is coupled to the red input RI. Similarly, the light output LO is coupled to the red output RO.

When the first relay 28 is in the active position, the first switch 36 couples the light input LI with the yellow input YI. Similarly, the light output LO is connected to the yellow output YO.

When the second relay 30 is in the active position, the first switch 36 couples the light input LI and the input of the second switch 38 which is coupled to the green input GI through the second switch.

When the second relay 30 is in the active position, the light input LI is coupled to the green input GI. Similarly, the light output LO is coupled to the green output GO.

The working of such a searchlight signal will now be described.

By default, the voltage between the control output CO and the control input CI is different from the first voltage and the second voltage, for example, equal to 0V. The first relay 28 and the second relay 30 are in the inactive position. Therefore, the red input and output RI, RO are connected to the power output and input PO, PI of the controller. A signal is fed to the red LED. The battery output BO is connected to the first reference input RI1 of the controller. This is detected by the controller 12 and is interpreted as "the signal is red".

In a first case, the voltage from the control input CI to the control output CO is substantially equal to the first voltage. The first relay 28 is in the active position. Therefore, the yellow input and output YI, YO are connected to the power output and input PO, PI of the controller. A signal is fed to the yellow LED. The battery output BO is connected to the second reference input RI2 of the controller. This is detected by the controller 12 and is interpreted as "the signal is yellow".

In a second case, the voltage from the control input CI to the control output CO is substantially equal to the second voltage. The second relay 30 is in the active position. Therefore, the green input and output GI, GO are connected to the power output and input PO, PI of the controller. A signal is fed to the green LED. The battery output BO is connected to the third reference input RI3 of the controller. This is detected by the controller 12 and is interpreted as "the signal is green".

If the detected reference input coupled to the battery output is incoherent with the voltage signal fed by the control output and input CO, CI of the controller, no signal is fed to the LEDs by the controller through the power output and input PO, PI.

If the detected reference input coupled to the battery output is coherent with the voltage signal fed by the control output and input CO, CI of the controller, a signal is fed to one of the LEDs by the controller through the power output and input PO, PI.

The sub-assembly of the invention can be easily integrated in existing searchlight signal housing. Moreover the module interface couples the controller with the LEDs without having to change the logic of the controller or the connections between the controller and the sub-assembly.

In another embodiment, the interface module is not integrated in the searchlight signal housing with the LEDs for convenience. The interface module may be located at the base of a signal mast or in the bungalow with the controller.

When a cable is cut, either no energy is applied to the relays or the feedback is not coherent. The signal is then either red or turned off. The most restrictive signal aspect is displayed. The searchlight signal has a failsafe design by virtue of the failure modes of the vital relays used in the design.

The present invention also concerns any combination of the previously described embodiments.

The invention claimed is:

1. A sub-assembly for a searchlight signal comprising:
- three distinct light emitting diodes and
- an interface module for connecting the three light emitting diodes to a controller, the controller being adapted to control one bulb and three filters, the interface module comprising:
- a light input adapted to receive a signal for feeding a light emitting diode,
- a selecting circuitry interposed between the light input and the light emitting diodes,
- the selecting circuitry being adapted to select one light emitting diodes to be fed by the signal received by the light input,
- a first relay having an active position and an inactive position, and
- a second relay having an active position and an inactive position,
- the first relay and the second relay controlling the selecting circuitry, such that:
  - when the second relay and the first relay are in the inactive position, the light input is fed to a first LED,
  - when the first relay is in the active position, the light input is fed to a second LED, and
  - when the second relay is in the active position, the light input is fed to a third LED.

2. The sub-assembly according to claim 1, wherein the selecting circuitry comprises conducting lines with two-position switches.

3. The sub-assembly according to claim 2, wherein each two-position switch is commanded by the relays.

4. The sub-assembly according to claim 1, wherein the selecting circuitry consists of conducting lines with two two-position switches.

5. The sub-assembly according to claim 4, wherein each two-position switch is commanded by a respective relay.

6. The sub-assembly according to claim 1, wherein the first LED is a red LED.

7. The sub-assembly according to claim 1, wherein the interface module comprises a switching input and a switching output adapted to receive a voltage signal, the first relay and the second relay being connected between the switching input and the switching output in parallel, the first relay being in the active position when a signal having a first voltage is received, the second relay being in the active position when a signal having a second voltage is received.

8. The sub-assembly according to claim 1, wherein the first relay and the second relay are combined into a single relay, the inactive position of the first relay and the inactive position of the second relay being an inactive position of the single relay, the active position of the first relay being a first active position of the single relay, the active position of the second being a second active position of the single relay.

9. The sub-assembly according to claim 1, wherein the interface module comprises:
- a first reference output,
- a second reference output,
- a third reference output and
- a feedback input, the first relay and the second relay being further adapted such that:

when the second relay and the first relay are in the inactive position, the first reference output and the feedback input are connected, when the first relay is in the active position, the second reference output and the feedback input are connected, and when the second relay is in the active position, the third reference output and the feedback input are connected.

10. An assembly comprising:

a sub-assembly according to claim 1, a searchlight signal housing, the sub-assembly being fitted inside the housing, and a controller adapted to control one bulb and three filters and having a power output adapted to feed a signal to the light input, the power output of the controller being connected to the light input of the interface module.

11. The assembly according to claim 10, wherein the interface module comprises a switching input and a switching output adapted to receive a voltage signal, the first relay and the second relay being connected to the switching input and output in parallel, the first relay being in the active position when a signal having a first voltage is received, the second relay being in the active position when a signal having a second voltage is received, terminals of the controller being connected to the switching input and output of the interface module, the controller being adapted to feed a voltage signal to the switching input and output.

12. The assembly according to claim 11, wherein the controller comprises:

a first reference input, a second reference input and a third reference input and the interface module comprises:

a feedback input, the first relay and the second relay being further adapted such that:

when the second relay and the first relay are in the inactive position, the first reference input and the feedback input are connected, when the first relay is in the active position, the second reference input and the feedback input are connected, and when the second relay is in the active position, the third reference input and the feedback input are connected, a signal being fed by the controller to the light input when the reference input coupled to the feedback input is coherent with the voltage signal fed to the switching input.

13. Train infrastructure comprising an assembly according to claim 10.

* * * * *